US012540017B2

(12) United States Patent
McCormick

(10) Patent No.: US 12,540,017 B2
(45) Date of Patent: Feb. 3, 2026

(54) TRULY TAMPER-EVIDENT CONTAINER

(71) Applicant: Richard John McCormick, Newport Beach, CA (US)

(72) Inventor: Richard John McCormick, Newport Beach, CA (US)

( * ) Notice: Subject to any disclaimer, the term of this patent is extended or adjusted under 35 U.S.C. 154(b) by 0 days.

(21) Appl. No.: 18/175,901

(22) Filed: Feb. 28, 2023

(65) Prior Publication Data

US 2025/0051070 A1 Feb. 13, 2025

Related U.S. Application Data

(63) Continuation-in-part of application No. 16/810,059, filed on Mar. 5, 2020, now Pat. No. 11,618,621.

(51) Int. Cl.

| | |
|---|---|
| ***B65D 55/02*** | (2006.01) |
| ***B65D 35/44*** | (2006.01) |
| ***B65D 41/32*** | (2006.01) |
| ***B65D 47/08*** | (2006.01) |
| ***B65D 51/22*** | (2006.01) |
| ***B65D 51/24*** | (2006.01) |

(52) U.S. Cl.

CPC ..... *B65D 55/026* (2013.01); *B65D 35/44* (2013.01); *B65D 41/32* (2013.01); *B65D 47/0804* (2013.01); *B65D 51/22* (2013.01); *B65D 51/245* (2013.01)

(58) Field of Classification Search

CPC ..... B65D 55/026; B65D 35/44; B65D 41/32; B65D 47/0804; B65D 51/22; B65D 51/245; B65D 2251/0093; B65D 2251/0015

USPC ..... 215/232, 253

See application file for complete search history.

(56) References Cited

U.S. PATENT DOCUMENTS

| | | | | | |
|---|---|---|---|---|---|
| 4,266,687 | A * | 5/1981 | Cummings | A61J 1/1412 | 229/123.1 |
| 4,576,297 | A * | 3/1986 | Larson | B65D 55/02 | 215/250 |
| 4,579,240 | A * | 4/1986 | Ou-Yang | B65D 55/066 | 215/230 |
| 4,687,113 | A * | 8/1987 | Reeve | B65D 55/066 | 215/250 |
| 4,739,892 | A * | 4/1988 | Tudek | B65D 51/228 | 215/257 |
| 4,747,499 | A * | 5/1988 | Gach | B65D 55/066 | 215/276 |

(Continued)

*Primary Examiner* — James N Smalley

(57) ABSTRACT

A tamper-evident container includes a tape (46). The tape is designed to break apart when the lid is opened for the first time. In some embodiments, a cap and lid are clear and see-through which allows a customer to see if the tape is torn apart and know whether the product has been tampered with. Some embodiments also include at least one screw thread (84) on a body neck (50) on the top of the container body (10) and on an inner wall (60) of a container cap (12). A removable gummy glue (62) or other adhesion mechanism is adhered on top of a mouth cover (66). When the container cap is unscrewed for the first time, the gummy glue is designed to indicate tampering. For example, the glue could be stretched, come apart, or separate from the mouth cover, or the underside of the cap, or distort an image that was on the gummy glue, such as a manufacturer's logo, name, trademark, or design, or leave an image from the mouth cover on the gummy glue, visually indicating that the container has been opened at least once.

22 Claims, 20 Drawing Sheets

(56) References Cited

U.S. PATENT DOCUMENTS

| | | | | | |
|---|---|---|---|---|---|
| 4,782,967 | A * | 11/1988 | Thomas | B65D 55/066 | 206/532 |
| 4,984,700 | A * | 1/1991 | Knickerbocker | B65D 51/18 | 215/250 |
| 5,111,978 | A * | 5/1992 | Mengeu | B65D 51/18 | 222/545 |
| 5,119,964 | A * | 6/1992 | Witt | B65D 51/20 | 215/232 |
| 11,208,238 | B2 * | 12/2021 | Conaway | B32B 27/36 | |
| 2019/0231971 | A1 * | 8/2019 | Verlaak | A61B 50/30 | |

* cited by examiner

TRULY TAMPER-EVIDENT CONTAINER

CROSS-REFERENCE TO RELATED APPLICATIONS

This is a Continuation-In-Part of application Ser. No. 16/810,059, filed with the title Truly Tamper-evident Container" on Mar. 5, 2020, and naming Rick McCormick as inventor, the entire content of which is hereby incorporated herein by reference.

BACKGROUND OF THE INVENTION

This disclosure relates to product packaging, specifically, the tamper-proofing of product containers.

Man has always required various storage containers for transporting and holding various goods such as water, wine, grains, precious metals, etc. Different goods required different types of containers (pots, bottles, etc.), but they were often large and made of heavy materials which made the cost of transportation very expensive and difficult, and, due to insufficient securities in place such as weak locks, the materials used (ivory, shellac, or rubber), lack of surveillance systems, etc., could easily be stolen, broken into, or tampered with.

The Tylenol scare in the early 1980s was an eyeopener for everyone throughout the world, especially for the manufacturers of pharmaceutical products that are taken orally. The sabotaging of eye drop products, as well as numerous other copycat product tampering crimes, forced the public to demand safer packaging that could not be tampered with. With the onslaught of numerous lawsuits against manufacturers, companies responded with new protections (safety shrink bands, glued outer packaging cartons, tape strips, etc.) to serve as inexpensive early warning systems to let customers know if a product may have been tampered with.

Consumers have always wanted reliable, high-quality products that are inexpensive and easy to use. The manufacturers, with the fear of lawsuits and their reputations on the line, try to accommodate the consumers in this regard while trying to make the packaging unencumbering and safe to use, all while trying to keep their manufacturing costs to a minimum. They could make their packaging safe out of heavy, expensive materials, such as steel or glass, but the costs would be prohibitive and not convenient for their customers. If they are made of cheap materials with poor designs and construction, they risk having products that may be easily tampered with. Where is the balance of safety and convenience at a reasonable cost? This is the dilemma the manufacturers face.

Back in 1841, an American portrait painter named John Rand needed containers for his messy paints, so he invented the squeezable metal tube or collapsible tube. In 1870, New Yorker Henry Palmer patented a screw-top collapsible container intended for the storage of condensed medicinal extracts. The screw-top collapsible container, collapsible tube or squeeze tube, is still very prevalent amongst today's products found in pharmacies throughout the world. They are inexpensive, lightweight, and easy to carry or transport.

In 1889, toothpaste in a tube was introduced by Johnson & Johnson. It is the most common item sold in collapsible tubes to this day and almost every household has at least a few collapsible tubes in their home. Collapsible tubes are just one of the many excellent candidates for tamper-evident containers.

A few collapsible tube closures or systems have been proposed—for example, in U.S. Pat. No. 10,435,198 to Turcotte (2019), 4,181,246 to Norris (1980), and Bray Pub. No.: US 2009/0065528 (2009-3-12)/U.S. Provisional Pat. App. No. 60/970,750, 9,499,313 to Zhong, et al, but they do not use a simple, cost-effective manner in which to keep potential saboteurs from perpetrating dastardly acts on product containers, many of which are pharmaceutical products to be taken orally or rubbed onto one's skin. This would include the region of the nose and mouth known as the "Danger Triangle of the Face." These substances and medicines should carry the utmost protection from those who would want to cause harm or ill will by means of disfiguring another person's face, body, ruining their overall health, or, worse yet, the killing of the products' users.

Turcotte's patent, more or less, deals with maximizing the amount of space on the packaging, so as to increase the amount of space for advertising. Norris's "Closure for A Collapsible Tube" involves a collapsible tube container with a top that has a rotating spherical ball where the product dispenses from various ports. Bray's Tube Packaging System has the "head" lid section molded into the main body where the product is located, rather than most tube lids that are added as a second piece to the main body. Bray is going after a reduced number of components to reduce the cost of the tube, which is fine, but not if it's at the expense of the consumer's health, protection, and well-being, or the shareholders of a publicly-traded corporation with regard to the potential sabotage of the product's contents.

Zhong, et al. patent is, like many of the researched patents, very elaborate and involved a rotatable and removable cap that is mounted on a tube. It includes fixed wings, a safety outer ring, multiple safety pawls which are equally distributed on the inner side of the outer safety ring, a ratchet tooth that, when engaged, won't allow reversible motion. Such intricate safety caps are usually cost-prohibitive to a manufacturer, and thus the customer, to whom the manufacturer would have to pass on this exorbitant cost.

The problem is that many of these products are in a competitive field, which includes generic brands once the patents expire, so the manufacturers are not in a position to pass on the high packaging costs to the customer. Many of these containers are not really tamper-evident as they are located on the outside of the container and can be taken off. There is no universal system of tamper-evident protection, so packaging varies from one product to another and this leaves the customer not knowing if there was supposed to be a tamper-evident tape or safety shrink band, etc. on the container, or not. The high-end, intricate, tamper-evident containers are cost-prohibitive and that is why many of them are not in use today. It comes down to a cost-versus-benefit analysis on the part of the manufacturers. They justify the odds of someone tampering with their product and causing harm to someone is not likely, so they spend just enough to make the packaging safe enough to instill confidence in the customers.

Even to this day, many healthcare and personal hygiene consumer products are packaged in a way that is easily susceptible to sabotage. At a recent packaging trade show, it was pointed out that 30% of the safety shrink band on packaging do not do their job as intended. They can be stretched, manipulated, or otherwise taken off without breaking off. Many containers have a cap that is screwed onto the container body. The only obstacle blocking a criminal with ill intent from slipping a foreign substance into the container is a piece of foil or paper covering the spout where the product exits. In fact, even to this day, numerous companies do not even use this foil or paper. Many people don't even check to see if the product has a piece of foil or paper protecting the contents. This would involve unscrewing the top in a retail store. How many people are going to do that? If there is no foil or paper covering the spout, how does the customer know if this is the standard operating procedure with how the manufacturer packages their product or not? Many customers assume there is nothing to be concerned about since so many manufacturers still make their products without the tamper-evident foil on the spout. Anyone who wants to do ill will can simply unscrew the cap and put a foreign substance into the container. If there is a piece of foil covering the spout, anybody could simply lift the tabs on the foil and slip in a foreign substance, or keep the foil in place without lifting the pull tabs and puncture the foil using a hypodermic needle to inject, say, an acid. Then, they could simply place a piece of foil from an identical product on top. One could probably get away with simply leaving the needle puncture mark in the foil without anyone noticing as the odds of anybody noticing would be quite small. It's a numbers game. They could use a needle on a hundred packages and maybe only a few would be discovered.

For most products, each time the product is used, the cap must be unscrewed to get to the contents and then screwed back on once the product has been dispensed. This is a waste of time played out by people across the world each day. To save time, product designers came up with the flip-up lid, but this just added another entry point for saboteurs and is mostly for slow, gel-like viscosity products like shampoo, lotions, and toothpaste. Most product packages, including those that have a screw-on cap, and/or a flip-up lid, is susceptible to sabotage. It is in everyone's best interest, both for consumers and the manufacturers, to make sure that all consumer product containers are made tamper-evident to reduce serious illness, injury, or death.

Today's consumer product containers suffer from a number of disadvantages:

(a) They can easily be tampered with simply by unscrewing the cap from the product body and adding a foreign substance through the spout. Many stores run skeleton crews on the sales floor which allows saboteurs to easily tamper with products without being discovered.

(b) They can easily be tampered with by simply peeling back a piece of "tamper-evident" tape located at the lid opening on the outside of the cap.

(c) The foil or paper covering the spout where the product exits can simply be peeled back, taken off entirely, have a new foil placed on top of, or in place of, the original foil after the product has been sabotaged by inserting a hypodermic needle, etc.

(d) There is no consistency with product protection from one company's products to another's. That is, some companies use foil to cover their spouts and some use nothing. If they don't all use the same universal protection system (all use foil covering the spout, tape on the outside of the cap, safety shrink band, etc.), then how does the customer really know if the product has had these "tamperproof" items removed from the container or if the manufacturer never used them to begin with? How do customers know which "tamperproof" system is being applied by the different manufacturers if any? When a customer purchases an item, it's usually one "facing", that is, each unique item has one stock-keeping unit (SKU) on the counter shelf with the identical item directly behind it. The customer usually just picks out a product and sets it into their shopping basket or cart. He or she doesn't check to see how the other identical items lined up behind their product are protected (with a safety shrink band, outer tape, foil over the spout, etc.). The customer doesn't have the time to check every purchase they make at a store. Also, product packaging changes often, so what once may have been the product tamper-proofing system on a product, may have changed to an entirely unique tamper-proofing system the next time the customer purchases the same product.

(e) Very few of today's product containers have a clear, see-through cap and/or lid. If the customer can't see through to the spout foil (if there is one), how do they know whether the product has been tampered with, or not?

(f) Most, if not all, "tamper-evident safeguards" are located on the outside of the packaging where saboteurs have easy access to taking off, peeling back, stretching, altering, or removing these "protections" unbeknownst to the customer.

BRIEF SUMMARY OF THE INVENTION

In accordance with one embodiment, a product packaging container assembly comprises a tube in a clear, see-through cap, a body with a spout, and a tape.

In accordance with another improved embodiment, a product packaging container assembly comprises a clear, see-through cap, a body with a mouth, a mouth cover, and a gummy glue.

A number of advantages of my Truly Tamper-evident Container will become evident:

(a) The Truly Tamper-evident Container is difficult to defeat because it is inside the cap, so it is safer and gives a greater sense of confidence in the security of the product to the customer.

(b) The customer can immediately know whether the product has been tampered with, or not, simply by looking through the clear cap at the safety tape to see if it is broken, or not.

(c) It is more streamlined (by approximately 10%), so it uses fewer raw materials for the manufacturer and wastes less valuable shelf space for the retailer and consumer.

(d) Time is saved for the consumer who no longer has to waste time screwing on and screwing off the cap each time they use the product (which is daily in many instances).

(e) Corporations will not have nearly as many lawsuits brought against them, due to the fact that their products will be much harder to tamper with.

(f) Customers will no longer have to open the lid before purchasing to see for themselves whether the product has been tampered with.

(g) Almost every manufacturer can utilize this simple, uniform tamper-evident system.

(h) Increased sales and profits thanks to assured customers.

(i) Customer will no longer have to guess as to where the tamper-evident safeguard is located, or not know whether the manufacturer even uses a tamper-evident safeguard.

(j) An inexpensive safeguard for manufacturers.

(k) More consistent purity of ingredients as there is a lower chance of tainting.

(l) Build more trust and loyalty towards the manufacturer's products.

Accordingly, several advantages of one or more aspects are as follows: to provide product packaging containers that are truly simple and tamper-evident, quick to apply, greatly reduce/avoid injury or death to the consumer, have the public trust of the products with regard to the purity of their contents/ingredients, bring about goodwill for manufacturers who are proactive in combating the sabotage of their products, increased insurance of safety, better protection from lawsuits against manufacturers, retained or increased sales of name brands and generic brands due to a higher, newfound trust of manufacturers, shows manufacturers took good-faith effort/initiative in safely securing their products for their customers, lower lawsuit costs, reduced manufacturing costs due to fewer manufacturing steps which lead to higher margins, and a smaller, more streamlined cap, with potential savings, passed on to customers. These and other advantages of one or more aspects will become apparent from a consideration of the ensuing description and drawings.

BRIEF DESCRIPTION OF THE DRAWINGS

In the drawings, closely related figures have the same number but different alphabetic suffixes.

FIG. 4B has two breakaway points.

DRAWINGS—REFERENCE NUMERALS

10 Body
12 Cap
14 Lid
16 Body Spout
18 Hinge
20 Crater
22 Plateau
24 Plateau Rim
26 Tube
28 Footing
30 Breakaway Point
32 Punch Hole
34 Thumb Dent
36 Dent Overhang
38 Q-ring
40 Safety Shrink Band
42 Body Slope
44 Snap-off Studs
46 Safety Tape
48 Cap Spout
50 Body Neck
52 Safety Tape Fold
54 Sticky Side
56 Non-sticky Side
58 Safety Tape Sleeve
60 Inner Wall (of the lid)
62 Gummy Glue
64 Gummy Drop
66 Mouth Cover
68 Tab
70 Perforation
72 Double-sided Tape
74 Plastic
76 Suction End
78 Tape/Plastic Neck
80 Nick
82 Cap Spout Cover
84 Screw Thread
86 Contoured End
88 Mouth
90 Non-adhesive Item

DETAILED DESCRIPTION OF THE INVENTION

Figure 1A:
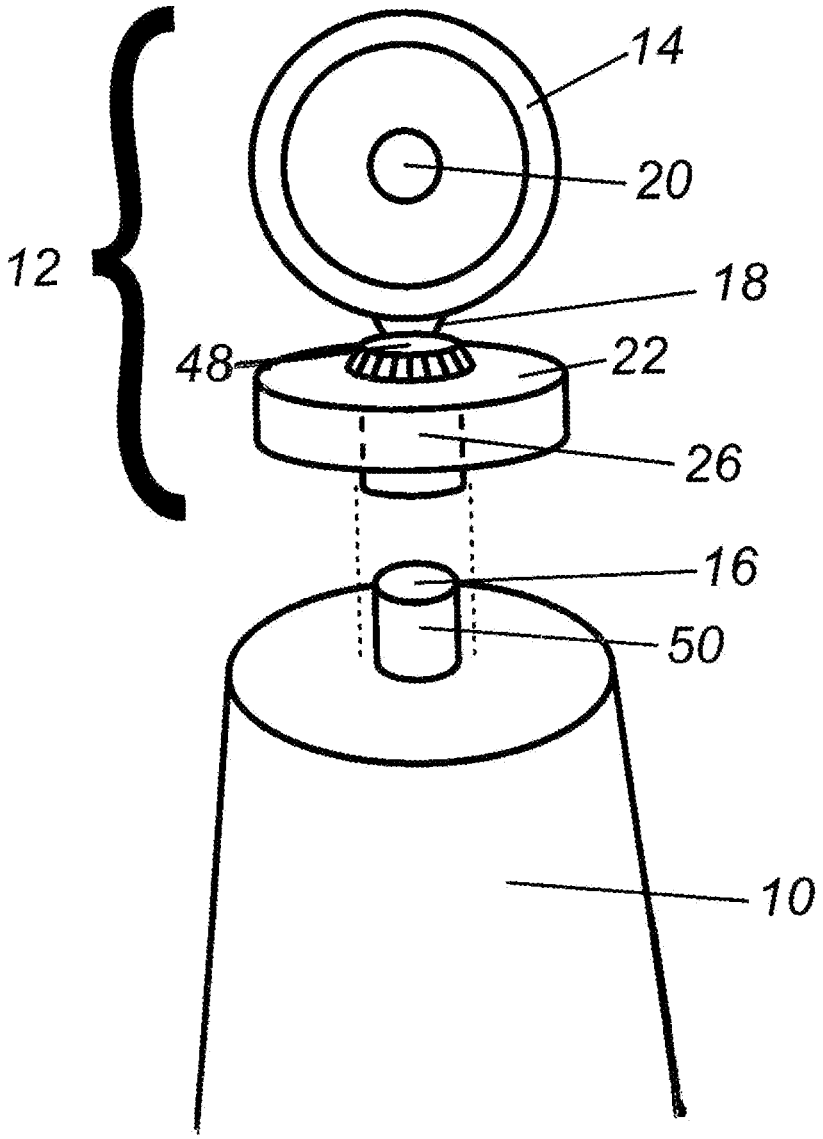
FIG. 1A is a front perspective view of a tamper-evident container with a tube of one embodiment.

One embodiment of the Truly Tamper-evident Container is illustrated in FIG. 1A (front view). The container is comprised of a cap (12) and a body (10), and can generally be made from a wide variety of plastics including polyethylene, high-density polyethylene (HDPE), low-density polyethylene (LDPE), polyethylene terephthalate (PET), etc., to hermetically seal and store such goods as shampoos, facial soaps, cosmetics, lotions, detergents, bleaches, motor oil, and numerous other products with varying degrees of viscosity. Steel, aluminum, and other metals can be used as well to store other contents such as paints and combustible liquids.

The cap (12) is clear and see-through which allows the customer to know immediately if the product about to be purchased has been tampered with or not. A screwless or threadless tube (26) is shown to descend vertically to an accepting screwless or threadless body neck (50).

The tube (26) could also be connected at a spout (16), brim, or flanged top of the container body. On the plateau (22) is a cap spout (48) where the product's contents, housed in the body (10), comes out.

Figure 2A:
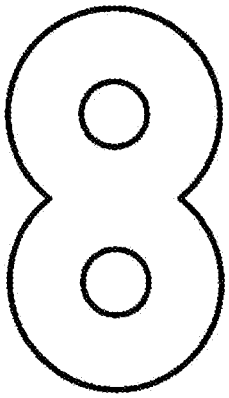
FIG. 2A is a flat, unfolded safety tape with no visible breakaway points and an average distance between the two punch holes of one embodiment.
Figure 2B:
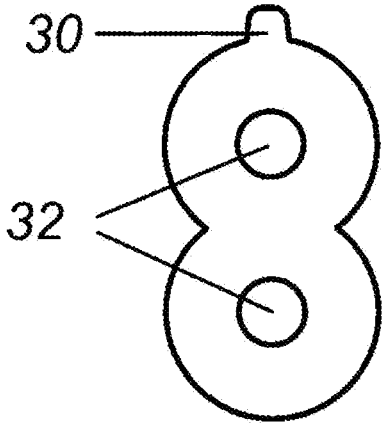
FIG. 2B is a safety tape with one breakaway point of another embodiment.
Figure 2C:
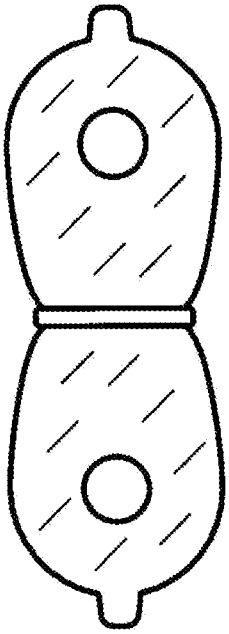
FIG. 2C is a safety tape with two breakaway points and a greater distance between the two punch holes of another embodiment.
Figure 2D:
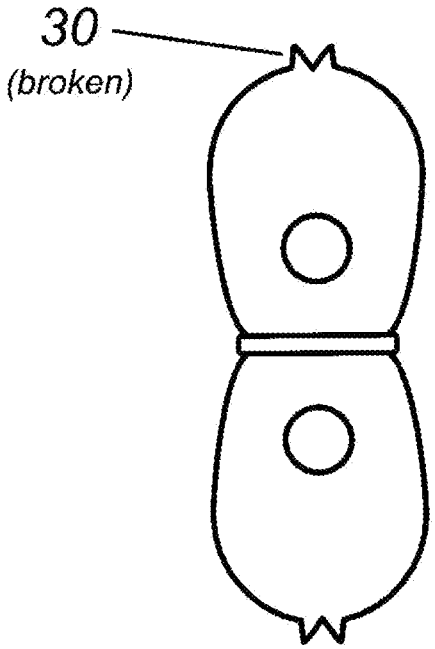
FIG. 2D is a safety tape with two broken breakaway points and a shorter distance between the two punch holes of another embodiment.

FIG. 2B shows a flat, unfolded, FIG. 8 shape safety tape (46) with one extended breakaway point (30) which, if broken, immediately indicates to a potential customer if the product has been opened or not. A flat, unfolded piece of safety tape (46) can be approximately one or two inches long, depending on the size of the plateau (22). The length can also vary depending on the tackiness of the tape itself, the strength necessary to hold the tape in place while the lid (14) is being opened, etc. Generally speaking, the larger the area covered with safety tape and the stronger the tackiness of tape, the better the tape holds its position while the lid (14) is first opened.

Figure 3:
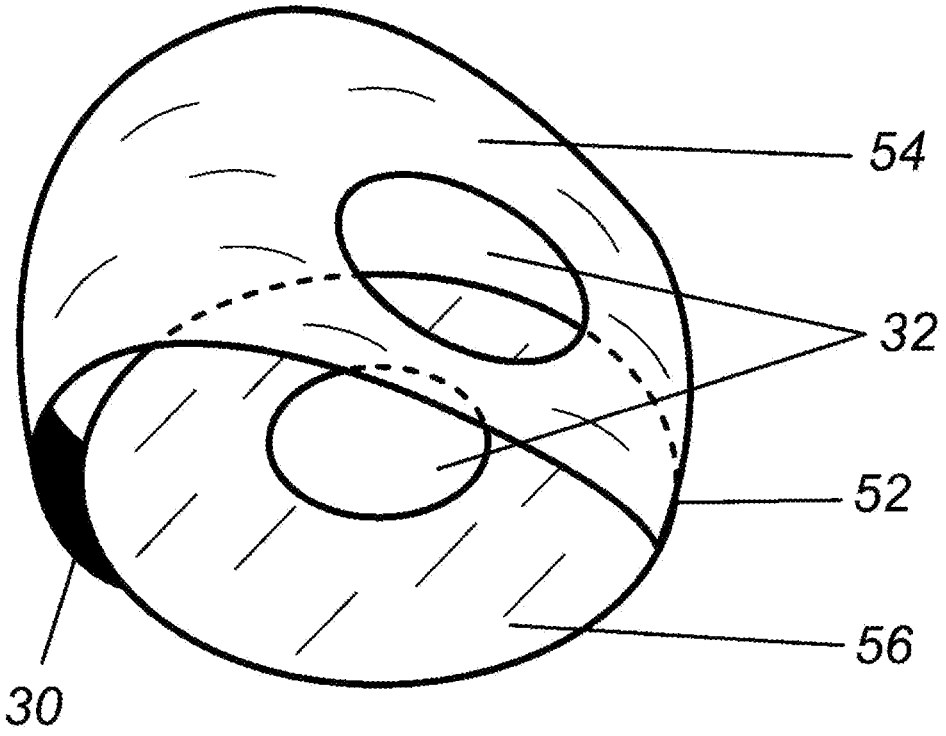
FIG. 3 is a side view of a folded safety tape.

FIG. 3 (side view) shows a folded safety tape (46) as it would appear inside a cap (12). One of the punch holes (32) would go around the cap spout (48) and the other punch hole (32) would go around the crater (20). Punch holes (32) are approximately 0.7 cm to 2 cm depending on the size of the crater (20) and cap spout (48) that they go around. On a flat, unfolded piece of safety tape (46), punch holes (32) are approximately half an inch to an inch and a half away from each other. The farther the punch holes (32) are away from one another, the wider the lid is allowed to open before the safety tape (46) becomes taut, and finally breaks. Therefore, the opposite is true. The shorter the distance between the punch holes means the lid does not open as wide before the safety tape (46) tears, thus, it is that much harder for a saboteur to try to put a foreign substance in through the cap spout (48). The tacky, sticky side (54) of the safety tape (46) is on the outer side, while the non-tacky, non-sticky side (56) is on the inner side of the tape.

Figure 4A:
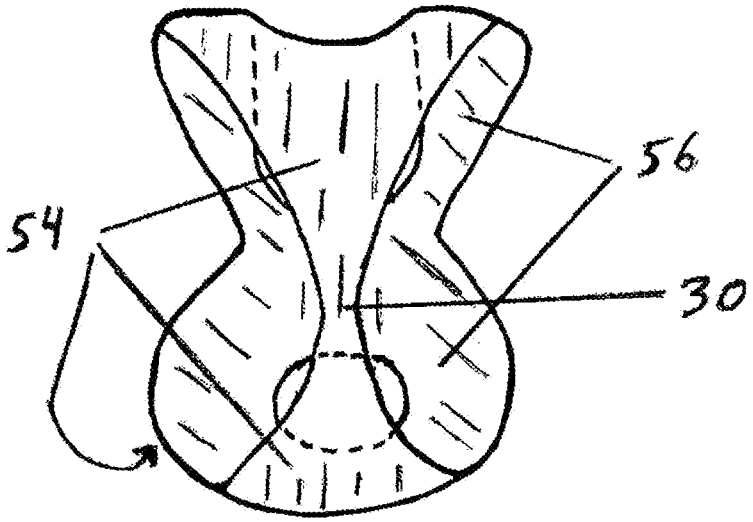
FIGS. 4A, 4B, and 4C are front views of various folded safety tapes with narrowed breakaway point(s).
Figure 4B:
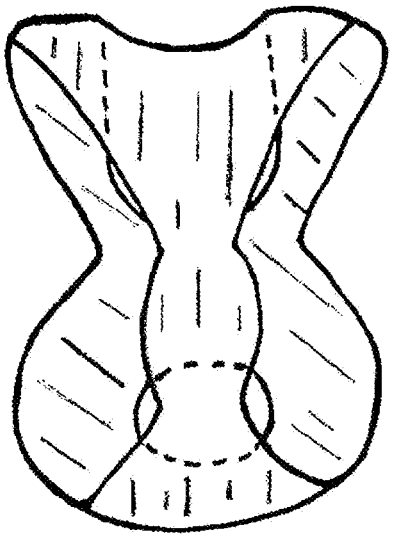
Figure 4C:
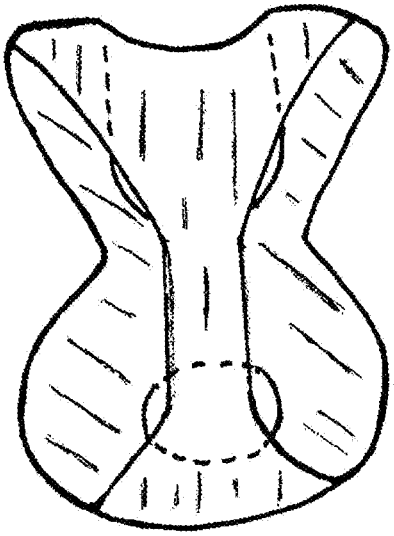
Figure 5A:
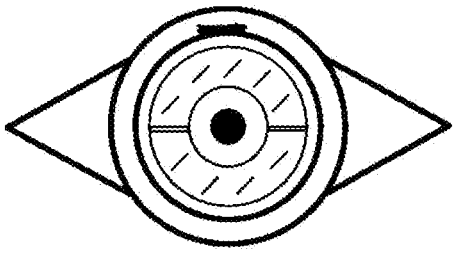
FIGS. 5A, 5B, 5C, and 5D are top views of various safety tape shapes and sizes as they sit on the plateau of collapsible tubes.

FIG. 4A (front view) shows a folded safety tape (46) with a narrow breakaway point (30). The breakaway point can be anywhere from approximately 0.25 cm to 2 cm or more. Generally speaking, the narrower the width at the breakaway point, the faster and easier it is for the safety tape to break apart. FIG. 5A (top view) shows a safety tape (46) completely surrounding the cap spout (48). FIG. 6B (side view) shows a broken safety tape (46) and a slightly ajar lid (14).

Operation—FIGS. 1A, 2B, 3, 4A, 5A, and 6B

The threadless tube (26), which is a member of the cap, is glued to the threadless body neck (50) by means of, perhaps, a heat-activated adhesive. As shown in FIG. 1A, there is not a male section screw-on thread system with an accepting female screw-on portion as is the case with many consumer products. This permanent connection of the cap (12) to the body (10) eliminates one main entry point to the product body for any potential saboteur.

Figure 1B:
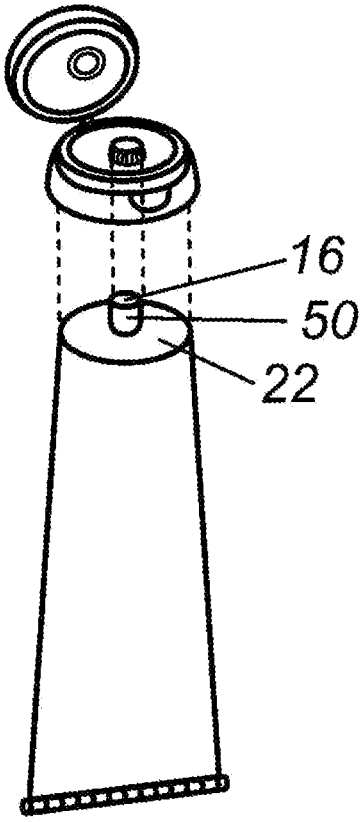
FIG. 1B is a tamper-evident container with a body neck on a flat body top of another embodiment.
Figure 1C:
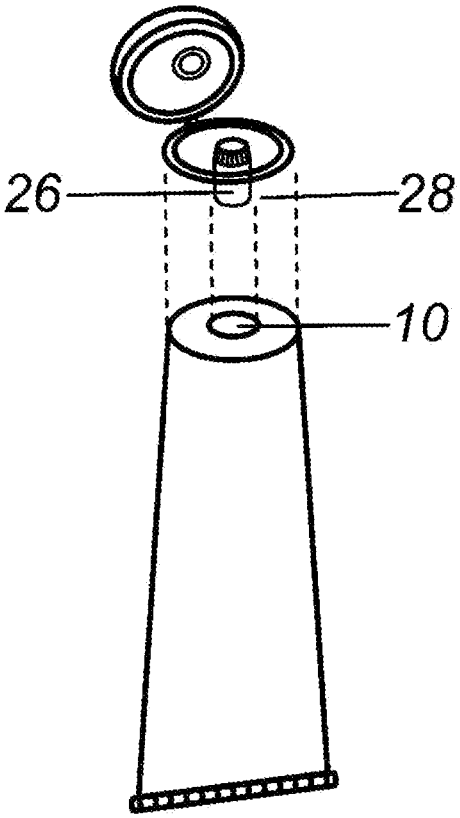
FIG. 1C is a tamper-evident container with footing and no spout on the body of another embodiment.
Figure 1D:
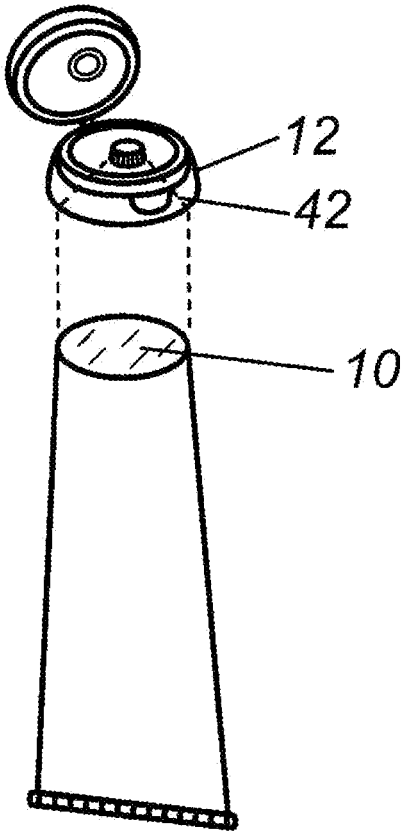
FIG. 1D is a tamper-evident container with sloping sides hidden within the cap that is sealed to the sides of a topless body of another embodiment.
Figure 1E:
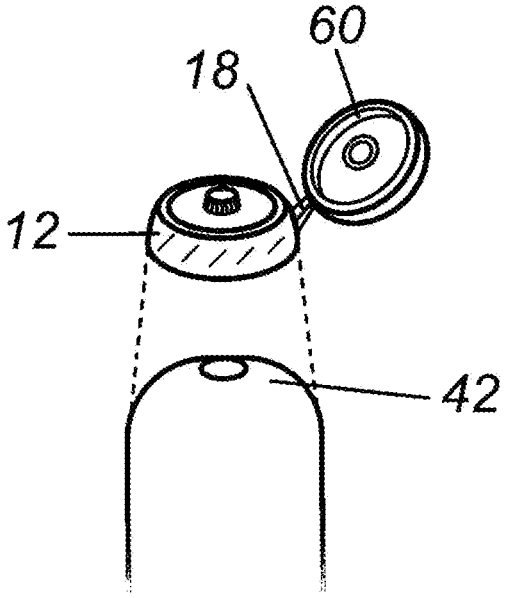
FIG. 1E is a tamper-evident container with a streamlined cap that is sealed to a slightly-sloped spoutless body of another embodiment.

A flat, unfolded safety tape (FIG. 2B) or a pre-folded safety tape (46), as shown in FIGS. 3 and 4A, is adhered to the underside of the lid (14) and to the top of the plateau (22). The sticky side (54) is on the outside and the non-sticky side (56) is on the inner side of the folded safety tape (46)

which starts on the underside of the lid (14) near the hinge (18) and inner wall (60) of the lid (FIG. 1E). The tape continues towards the center where a punch hole (32) allows for the safety tape (46) to go over and/or around the crater (20) and continue on towards the front opening of the lid (14). A breakaway point (30), generally located at the midway point on the safety tape (46), is located just inside at the front of the lid (14). It is not mandatory that the tape is adhered to the inner wall (60) of the lid at this point, so it doesn't have to have a sticky substance in this section of the tape. The safety tape (46) drops down to and is adhered to, the plateau as it runs back toward the cap spout (48). Another punch hole allows the safety tape (46) to move over and/or around the cap spout (48) as it moves towards the hinge (18). It comes to a stop at the safety tape fold (52) near the edge of the plateau rim (24) just before the hinge (18). The safety tape (46) never leaves outside of the cap (12), and, is thus, self-contained and free from being sabotaged without being detected. The safety tape (46) is generally compressed with some slack while it is in its resting place. Once the lid (14) is opened for the first time, the safety tape (46) becomes taut until it reaches its breaking point and tears apart. The broken safety tape (46) indicates that someone has opened this container and it should not be purchased. The safety tape (46) is to adhere to the container until the lid has been opened and the safety tape (46) has been broken. Then, it peels off easily without leaving any residue.

As shown in FIG. 5A, only one section of the safety tape (46), the top section adhered to the underside of the lid (14), is visible from above through the clear lid (14). The remaining part of the safety tape (46) is hidden underneath this top section and is adhered to the plateau (22). As shown in FIG. 6B, the lid (14) is open on the ajar cap (12) and the safety tape (46) has been broken, indicating the lid has been opened and that the customer should not purchase this item.

FIGS. 1B to 1E, 5B to 5D, 6A, 6C, 6D, 7A, 7B—ADDITIONAL EMBODIMENTS

FIG. 1B (front view) is shown with a body neck (50) and body spout (16) on the plateau (22).

FIG. 1C (front view) is shown with footing (28) at the base of the tube (26) and no spout on the top of the body (10).

FIG. 1D (front view) is shown a hidden body slope (42) within the cap (12) and a topless body (10).

FIG. 1E (front view) is shown with a hinge (18) connected to a streamlined cap (12) and a gradual sloping body slope (42). Also shown is the inner wall (60) of the lid.

Figure 5B:
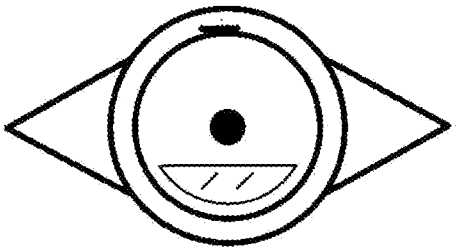
Figure 5C:
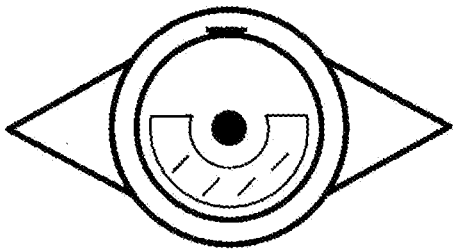
Figure 5D:
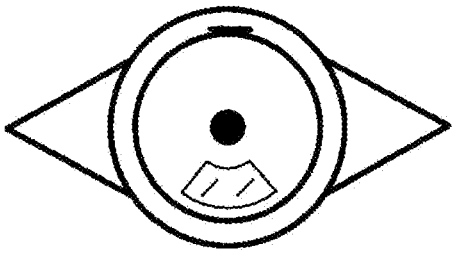

FIGS. 5B to 5D (top view) require less safety tape (46) covering a smaller area and accomplish the same goal of adhering to the lid (14) and plateau (22), but they would require a tape with a stronger tackiness due to the fact they would be spread over a smaller area.

Figure 6A:
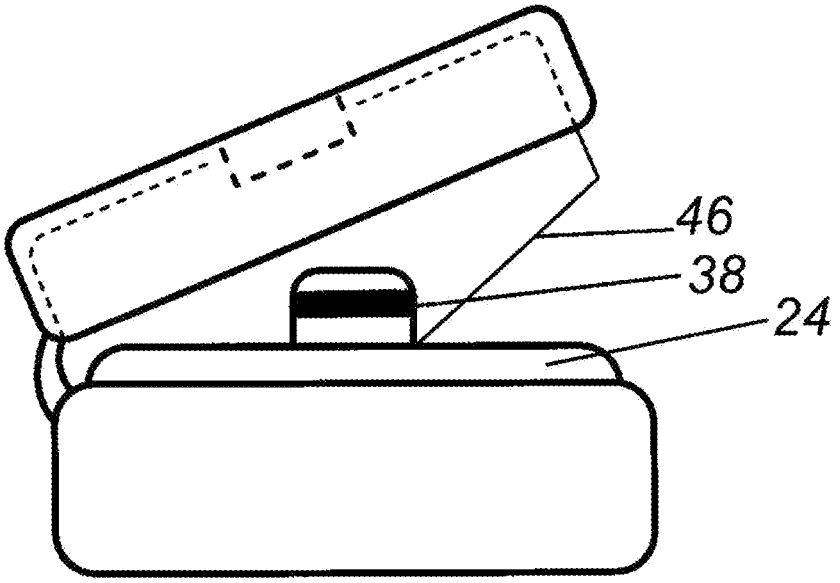
FIG. 6A is a side view of an ajar cap that shows the safety tape about to spring the taut safety shrink band of one embodiment.
Figure 6B:
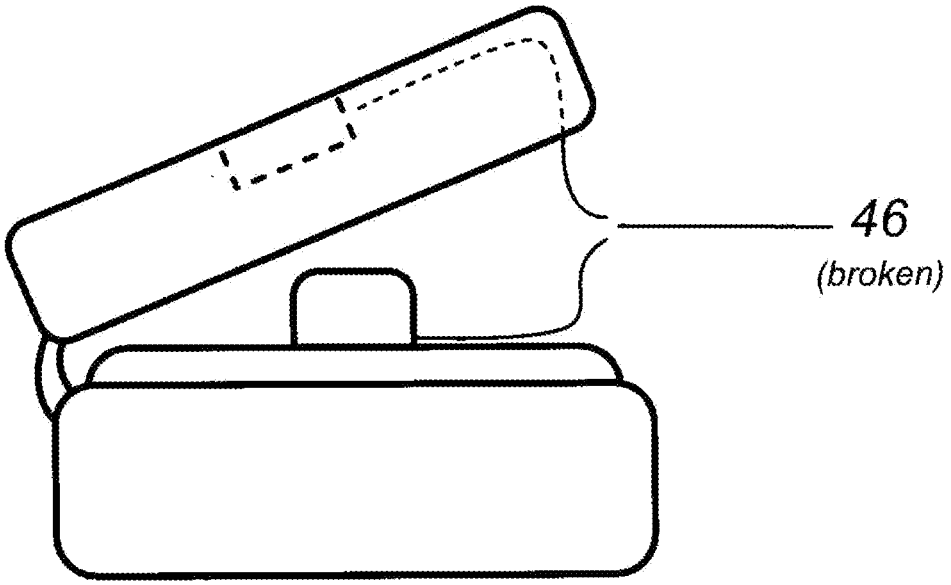
FIG. 6B is a side view of an ajar cap which shows the safety tape has been torn apart. The safety tape is only at the front half of the container as it does not go beyond the crater, nor the spout, of another embodiment.

FIG. 6A is a side view that shows a taut safety tape (46) which runs underneath a safety shrink band (40) and is about to pull up on the safety shrink band (40), which would tear it apart. An O-ring (38), or similar item, could be used in place of the safety shrink band (40) and would pop off once the tape is pulled up from underneath it. All of these would indicate that the lid (14) has been opened.

Figure 6C:
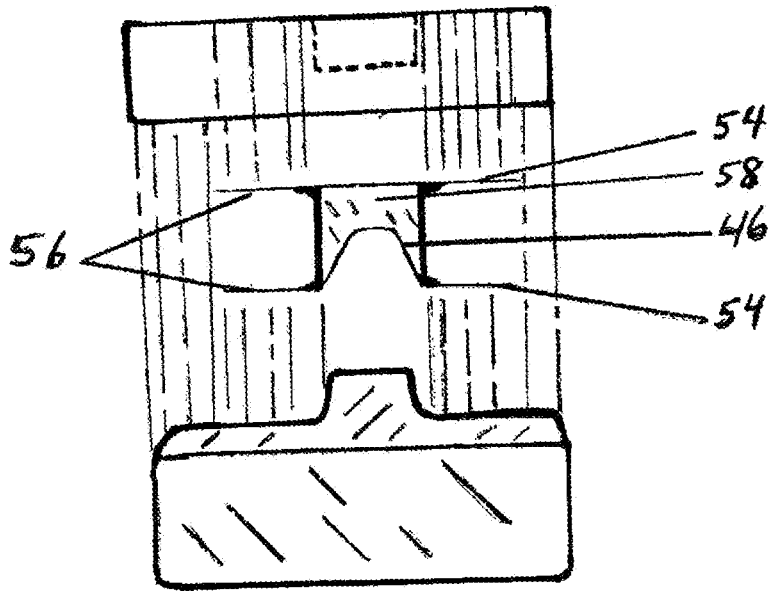
FIG. 6C is a front exploded view of a cap that shows centrally-located slack safety tape, which covers the spout, within a cylinder-shaped safety tape sleeve.

FIG. 6C (exploded view) is shown with a safety tape sleeve (58) which will break when stretched too far. Also, a safety tape (46) is shown within the safety tape sleeve (58) which rests over the cap spout (48) to act as an extra layer of safety.

Figure 6D:
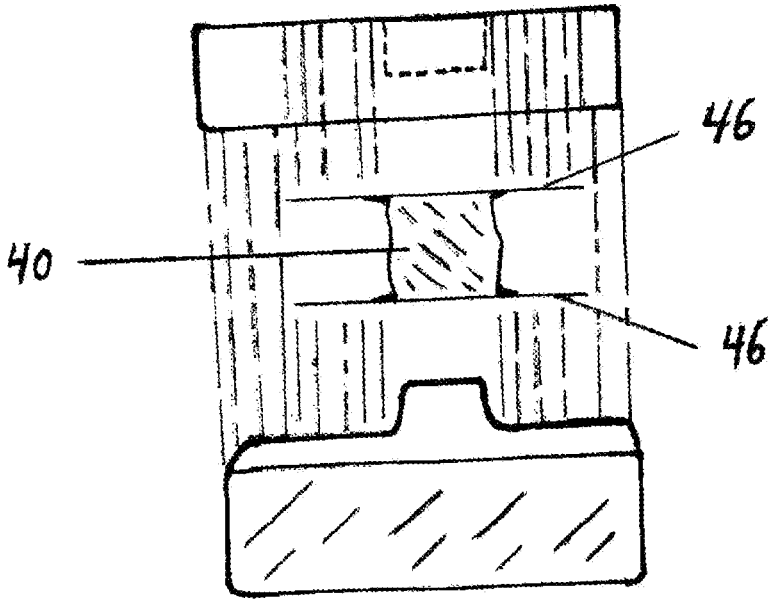
FIG. 6D is a front exploded view of a cap that shows safety tape as members on the top and bottom of a safety shrink band.

FIG. 6D (exploded view) is shown with a safety shrink band (40) which is connected to safety tape (46) on the top and bottom. The safety shrink band (40) pulls apart when stretched too far.

Figure 7A:
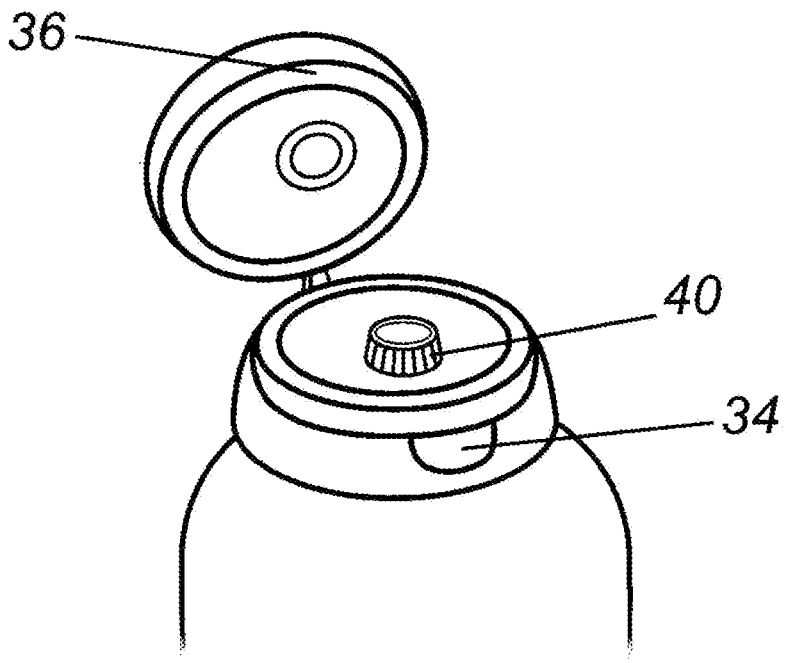
FIG. 7A is a front view of a tamper-evident container with a safety shrink band around a spout.

FIG. 7A (front view) is shown with the safety shrink band (40) around the cap spout (48). Illustrated on the outside of the cap are the thumb dent (34) and thumb overhang (36) which allow the consumer to easily open the lid (14).

Figure 7B:
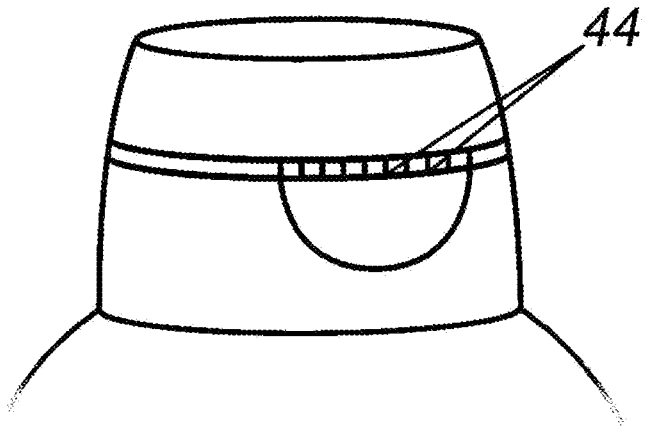
FIG. 7B is a front view of a closed tamper-evident container with sealed snap-off studs of one embodiment.

FIG. 7B (front view) is shown with snap off studs (44) which break apart to indicate when the lid (14) had been opened.

Figure 12:
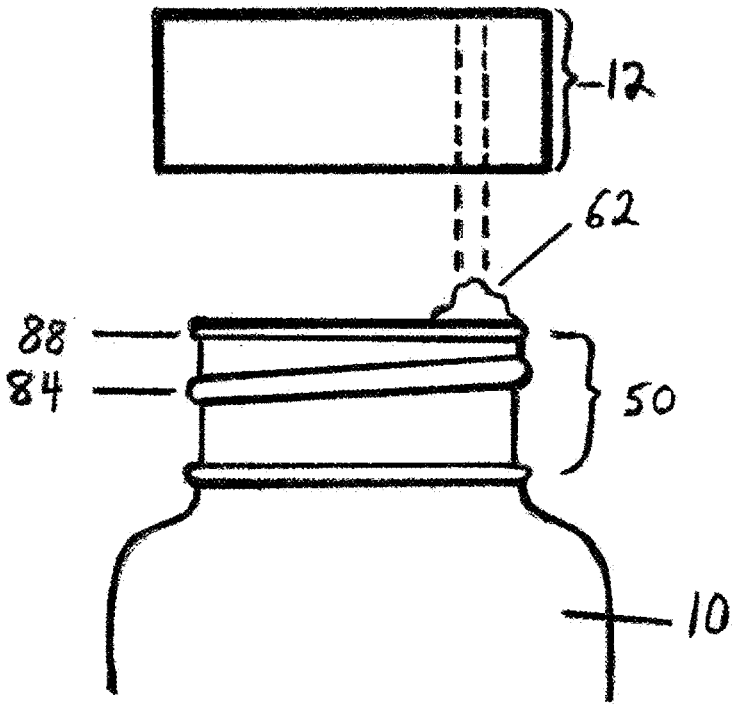
FIG. 12 is a front view of a tamper-evident container with gummy glue on top of a mouth cover which is on top of a mouth.

One improved embodiment of the Truly Tamper-evident Container is illustrated in FIG. 12 (front view) which is used to hermetically seal and store such goods as vitamins, aspirins, and the like. The container is comprised of a cap (12), a body (10), and an adhesive, such as gummy glue (62). The cap (12) and body (10) can generally be made from a wide variety of plastics including polyethylene, high-density polyethylene (HDPE), low-density polyethylene (LDPE), polyethylene terephthalate (PET), etc.

The cap (12) is clear or see-through which allows the customer to know immediately if the product, about to be purchased, has been tampered with or not. A body neck (50) has at least one screw thread (84) that can accommodate an accepting cap (12). On top of the body neck (50) is a mouth (88) and on top of the mouth (88) is a mouth cover (66) which keeps the product hermetically sealed and allows for the placement of an adhesive on top. On top of the mouth cover (66) is a gummy glue (62) in this example, but a wide array of other adhesives, such as tape, rubber, plastic, rubber cement, edible glue, craft glue, white glue, latex, vinyl, etc., may be used. If the cap were to be unscrewed before it is purchased, say, by a potential saboteur in a retail store, the purchaser could visibly see that breach, as indicated by the torn, broken gummy glue, or distorted print on the gummy glue, through the clear cap.

Figure 11:
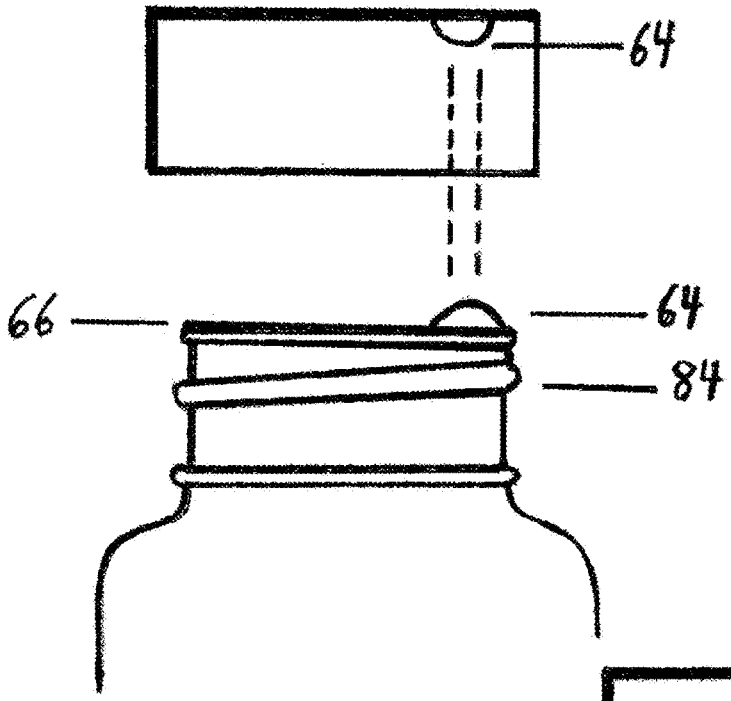
FIG. 11 is a front perspective view of a tamper-evident container with a gummy drop on the underside of the container cap and on top of a mouth cover.

FIG. 11 shows another improved embodiment where a gummy drop (64) is located on the underside of the cap and another gummy drop (64) is located on the mouth cover (66). When the cap is screwed onto the body in the manufacturing process, the two gummy drops press against one another and remain that way until the cap is unscrewed for the first time by the purchaser or end user.

Figure 13:
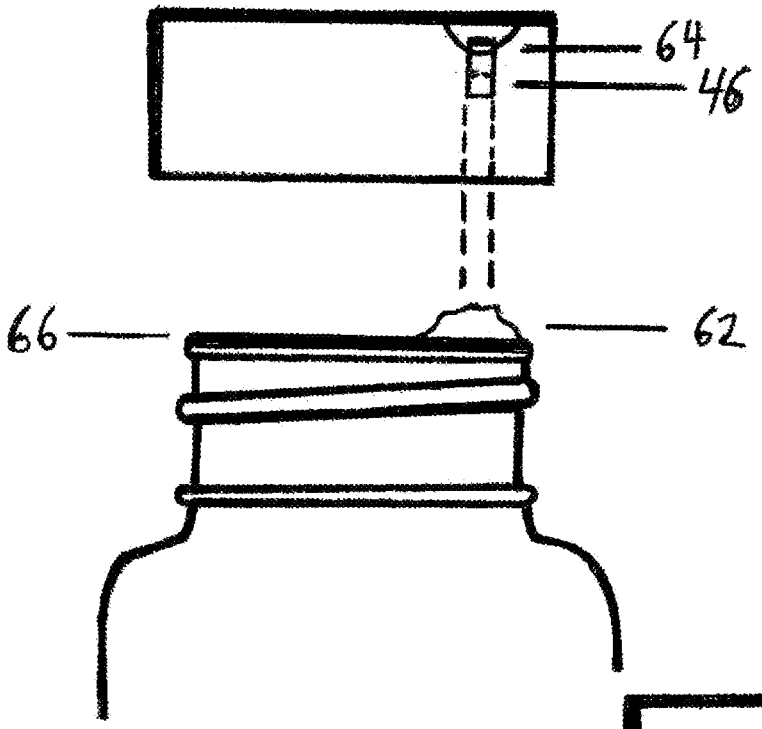
FIG. 13 is a front view of a tamper-evident container with tape dangling from a gummy drop from the underside of the container cap and a gummy glue on top of a mouth cover.

FIG. 13 shows a safety tape (46) dangling vertically from a gummy drop (64) from the underside of the cap. When the cap is screwed onto the body, the safety tape (46) makes contact and adheres to the gummy glue (62) on the mouth cover (66). When the cap is unscrewed for the first time, the safety tape (46) will come apart or become dislodged from the gummy glue (62) or gummy dot (64), indicating that the tamper-evident container has been opened at least one time. The safety tape (46) may be paper or most any item and does not necessarily have to have a sticky, tacky condition. Also, it may be positioned horizontally against the gummy drop, so that it may easily separate from the gummy dot, gummy glue, or both when the gummy dot or gummy glue is stretched when the cap is opened.

Figure 14:
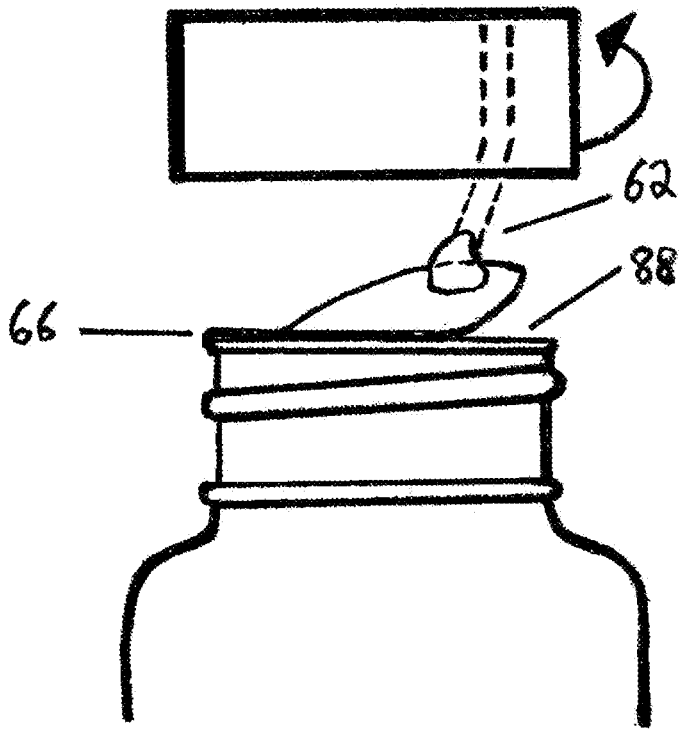
FIG. 14 is a front view of a tamper-evident container with gummy glue adhered to a mouth cover and the mouth cover is being pulled off of a mouth as the container cap is unscrewed.

FIG. 14 shows a gummy glue (62) adhered to a mouth cover (66). The mouth cover (66) is being lifted up from the mouth (88), which is at the top of the body neck (50), as the cap (12) rises as it is unscrewed from the body (10) for the first time.

Figure 15:
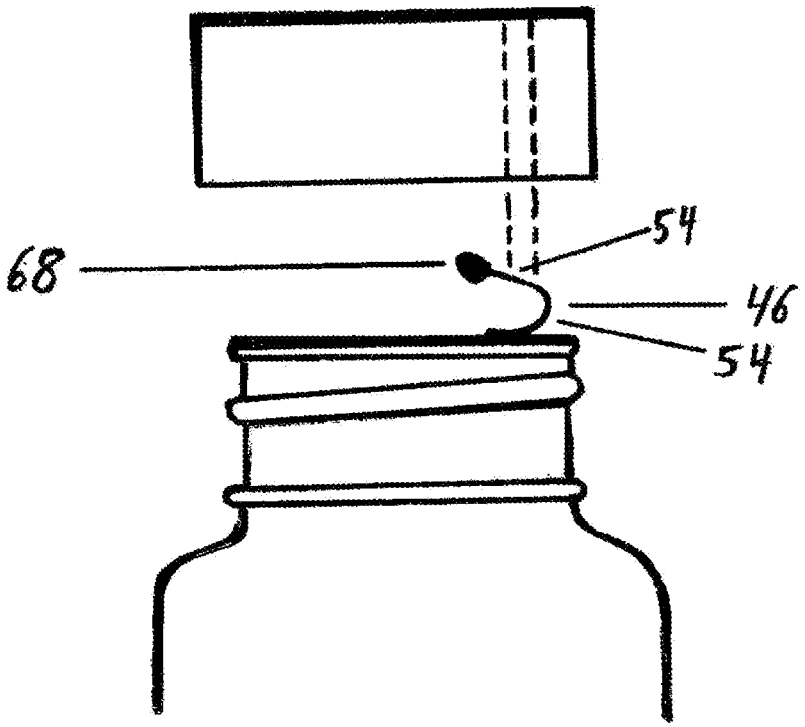
FIG. 15 is a front view of a tamper-evident container with a tab on the end of a tape.

FIG. 15 shows a safety tape (46) with a tab (68) at the end of the safety tape on top of a mouth cover (66). The sticky side (54) adheres to the underside of the cap or inner wall (60), and the mouth cover (66). When the cap is unscrewed, it tears the top of the mouth cover which indicates the tamper-evident container has been opened.

Figure 16:
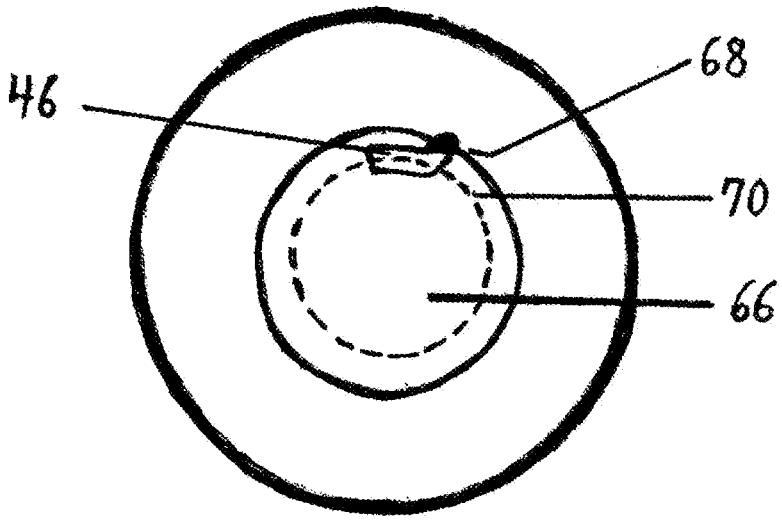
FIG. 16 is an aerial view of a tamper-evident container with a tab as a member of a mouth cover with perforation along the top of the mouth cover for easy tearing. Adhesive is on the tab.

FIG. 16 shows an aerial view of a tamper-evident container with a tab (68), as a member of the mouth cover (66), on a perforation (70). There is an adhesive on the tab.

Figure 17:
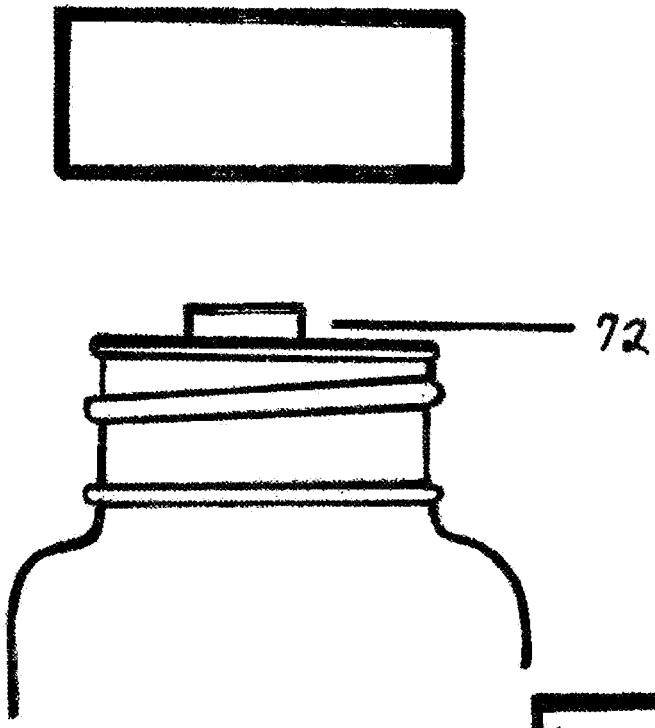
FIG. 17 is a front view of a tamper-evident container with double-sided tape adhered to a mouth cover.

FIG. 17 shows a double-sided tape (72) adhered to the top of a mouth cover (66). When the cap (12) is screwed onto the body (10) for the first time in the manufacturing process, the double-sided tape (72) presses and adheres to the underside of the cap. When the cap is unscrewed for the first time, the double-sided tape tears apart, perhaps skewing a manufacturer's print, logo, name, trademark, or design. The double-sided tape may be adhered on top of a perforation (70) on top of the mouth cover (66) which would tear open the mouth cover (66) when the cap is unscrewed to indicate that the container has been opened.

Figure 18:
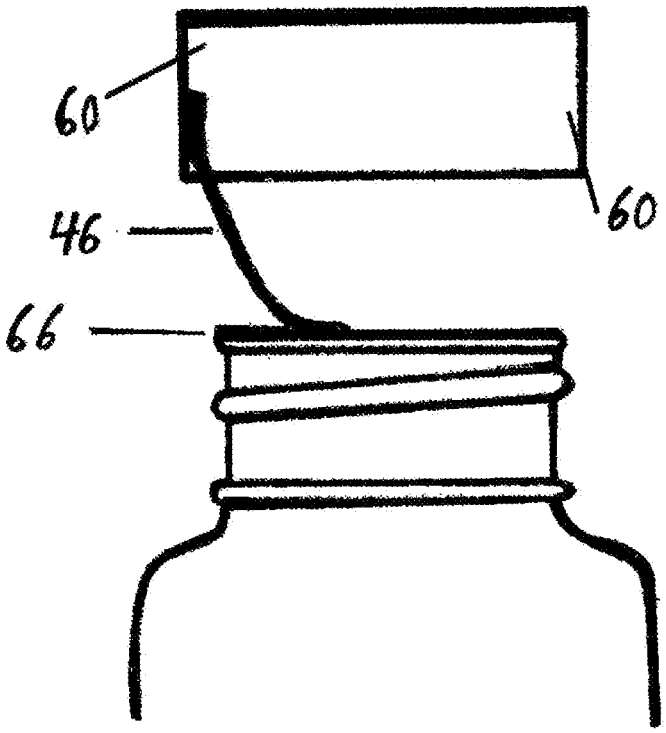
FIG. 18 is a front view of a tamper-evident container with tape adhered to the inner wall of the lid of the container cap and a mouth cover.

FIG. 18 shows a front perspective view of a tamper-evident container with one end of a tape (46) adhered to the inner wall (60) of the cap and the other end adhered to a mouth cover (66). When the cap (12) is unscrewed for the first time, the tape tears, indicating that the container has been opened.

Figure 19:
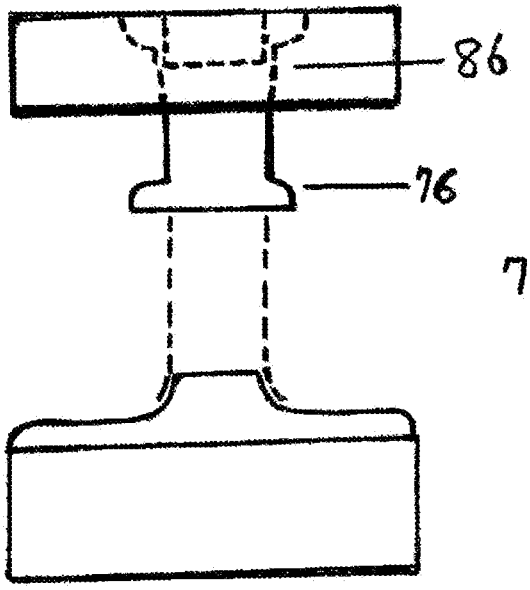
FIG. 19 is a front view of a flip-top tamper-evident container with a rubber cylinder with contoured ends and suction ends. One suction end is adhered over the crater on the underside of the lid of the container cap, while the other suction end will rest over the cap spout cover when the lid is closed.

FIG. 19 shows a front view of a flip-top tamper-evident container with a rubber cylinder adhesive with suction ends (76) adhered to the underside of the lid (14). The top end of the rubber cylinder is a contoured end (86) which allows it to go over the crater (20) on the underside of the lid (14), and the bottom end is a contoured end (86) to accommodate sliding over the cap spout (48). When the flip-top lid is closed in the manufacturing process, the bottom end of the rubber cylinder adheres to the cap spout (48) or plateau (22). A small quantity of water, petroleum jelly, oil, or other substance may be applied to the suction ends, crater, underside of the lid, cap spout, or plateau to create a stronger suction. When the lid is opened for the first time, the rubber cylinder comes apart or becomes dislodged from the lid, crater, cap spout, or plateau to indicate that the lid has been opened.

Figure 20:
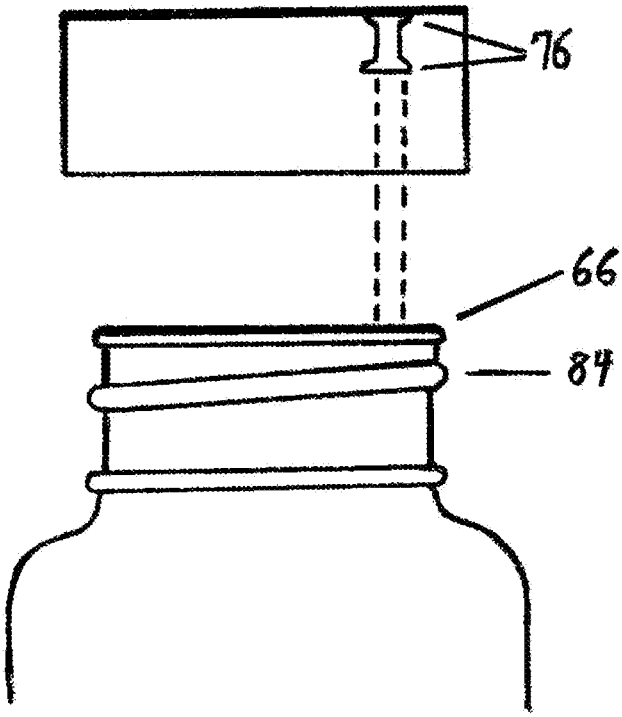
FIG. 20 is a front view of a tamper-evident container with a small plastic with suction ends. One suction end is adhered off-center on the underside of the container cap.

FIG. 20 shows a front view of a tamper-evident container with one screw thread (84) on the body neck (50) and with a plastic item with a suction end (76) off-center on the underside of the cap (12) and a suction end (76) on the bottom of the plastic. When the cap is screwed onto the body for the first time, the bottom suction end of the plastic adheres to the mouth cover (66).

When the cap is unscrewed for the first time, the plastic will come apart, stretch, or separate one or both suction ends from the underside of the cap or the mouth cover.

Figure 21:
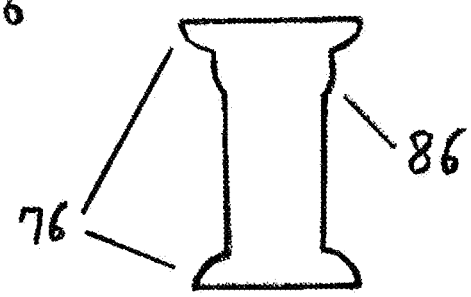
FIG. 21 is a front view of a plastic with suction ends and contoured ends to allow a better fit around a crater and a cap spout.

FIG. 21 shows a front view of a plastic item with contoured ends (86) and suction ends (76).

Figure 22A:
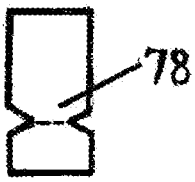
FIG. 22A is a front view of a tape with a narrow, perforated neck and two nicks.

FIG. 22A shows a front view of a tape (46) with a narrow, tape neck (78) formed by two nicks (80). A perforation (70) runs from one nick to the other nick to make the tearing of the tape easier. When the cap is unscrewed for the first time, the tape will tear along the perforation which will make it easier for weak and elderly individuals to remove the cap.

Figure 22B:
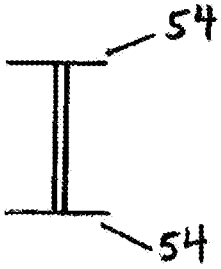
FIG. 22B is a front view of an I-shaped tape with a sticky side on the top of the tape and a sticky side on the bottom side of the tape.

FIG. 22B shows an I-shaped tape with a sticky side (54) on the top and on the bottom of the tape for adherence to the underside of caps and the top of mouth covers. The tape tears apart when the cap is unscrewed.

Figure 22C:
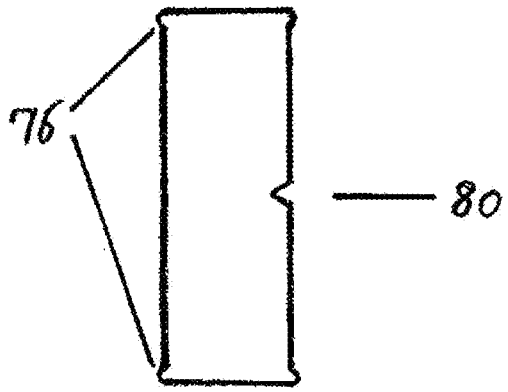
FIG. 22C is a front view of a long tape with one nick in the center of the side.

FIG. 22C shows a long tape with suction ends (76) and with one nick (80) in the middle of its side.

Figure 22F:
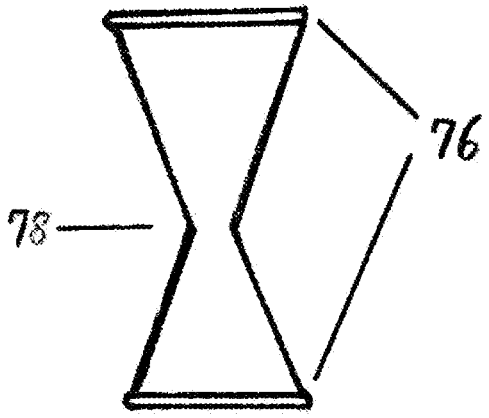
FIG. 22F is a front view of a sandglass-shaped plastic with narrow neck and suction ends.
Figure 22D:
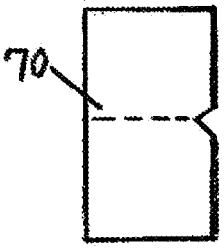
FIG. 22D is a front view of a short tape with one nick and a perforation.

FIG. 22D shows a short tape with one nick (80) in the middle of its side which leads to a perforation (70) running across the center to the other side.

Figure 22G:
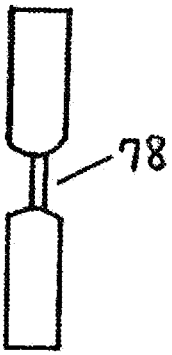
FIG. 22G is a front view of a butterfly bandage-shaped tape.
Figure 22E:
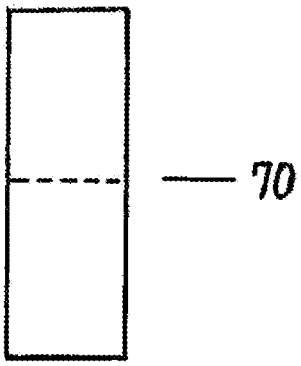
FIG. 22E is a front view of a long plastic with a perforation.

FIG. 22E shows a long plastic with a perforation (70) running from one side to the other across the center of the plastic.

FIG. 22F shows a sandglass-shaped plastic with a narrow neck (78) and suction ends (76) on both the top and bottom of the plastic.

FIG. 22G shows a butterfly bandage-shaped tape with a narrow neck (78) for easy tearing.

Figure 23A:
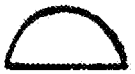
FIG. 23A is a front view of a gummy drop.

FIG. 23A shows a gummy drop. Gummy drops can be applied to many places, such as, the underside of caps, on top of plateaus, cap spout covers, mouth covers, or many other locations. When a container is opened for the first time, gummy drops may come apart or stretch to a point of indicating that the cap has been opened. When stretched, it may distort the shape, color, or print, such as the manufacturer's name, logo, trademark, or design on or within the gummy drop.

Figure 23B:
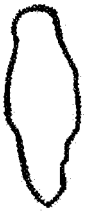
FIG. 23B is a front view of a gummy glue.

FIG. 23B shows a gummy glue. Like gummy drops, gummy glue has many applications for its use with the tamper-evident container. It can be applied to the underside of the caps, on top of plateaus, cap spout covers, mouth covers, or many other places. As with gummy drops, gummy glue may tear apart or be stretched to indicate that the tamper-evident container has been opened. The indication may appear as a distorted print, such as a manufacturer's name, logo, design, trademark, or shape of the gummy glue.

Figure 24:
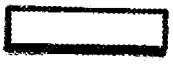
FIG. 24 is a front view of a double-sided tape.

FIG. 24 shows a double-sided tape (72) which can adhere to numerous locations such as the underside of a cap, on top of a plateau, cap spout cover, mouth cover, as well as adhered to a suction end (76), gummy glue, gummy drops, plastic, or another tape in order to accommodate the adherence of the safety tape (46), or any other part, or in any way, in order to leave an indication that the tamper-evident container has been opened. Double-sided tape may have, perhaps, the widest application use with regard to tamper-evident packaging.

Figure 25:
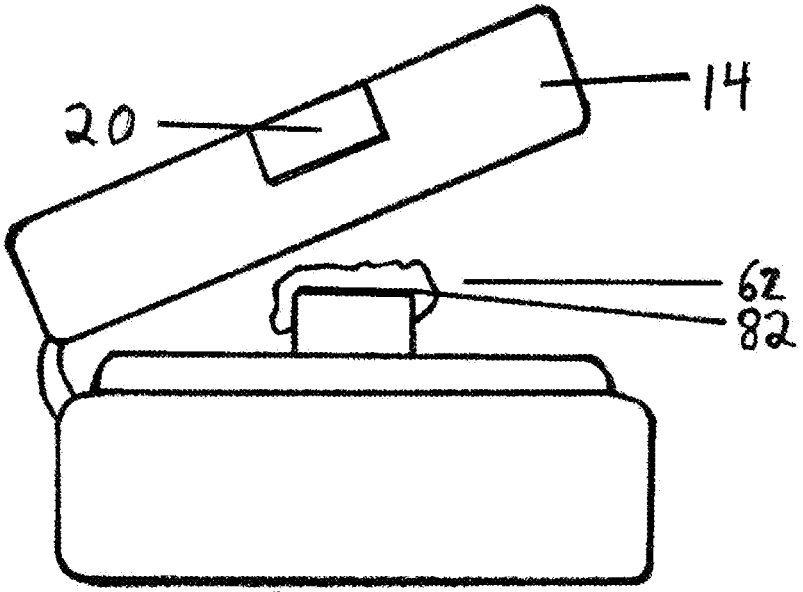
FIG. 25 is a side view of a flip-top tamper-evident container with gummy glue covering the cap spout.

FIG. 25 shows a flip-top tamper-evident container with a gummy glue (62) over the cap spout (48). When the flip-top lid (14) is closed in the manufacturing process, the crater (20) on the underside of the lid (14) is pressed down onto the gummy glue (62) where it remains adhered to the gummy glue until the flip-top lid (14) is opened for the first time. When the flip-top lid is opened for the first time, the gummy glue is pulled and stretched until it comes apart, or distorts the shape, color, trademark, or ink print on, or within the gummy glue, to indicate that the packaging has been opened.

Figure 26:
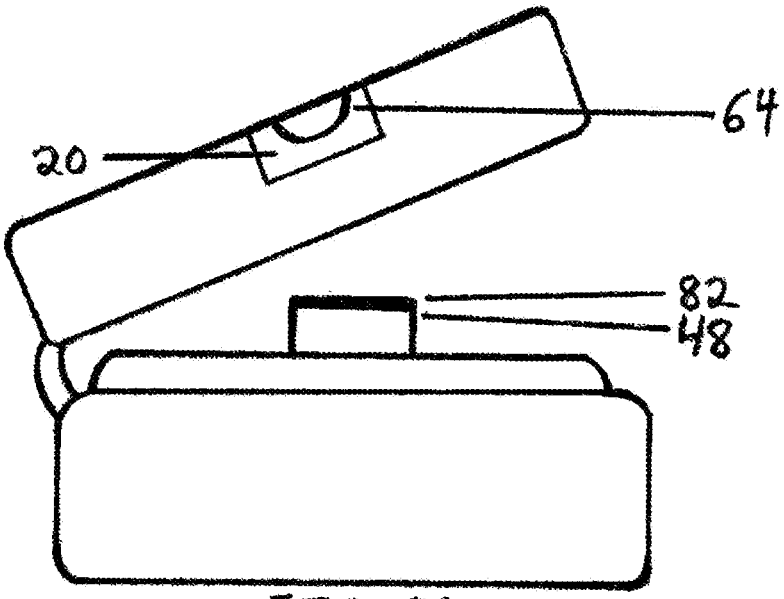
FIG. 26 is a side view of a flip-top tamper-evident container with a gummy drop inside the crater and a cap spout cover on top of a cap spout.

FIG. 26 shows a flip-top tamper-evident container with a gummy drop (64) inside the crater (20) and a cap spout cover (82) on top of the cap spout (48). When the flip-top lid is lowered for the first time in the manufacturing process, the gummy drop is pressed against the cap spout cover (82). When the lid is opened for the first time, the gummy drop is stretched and pulled apart or it pulls off or pulls apart the cap spout cover (82), or both, indicating that the container has been opened.

Figure 27:
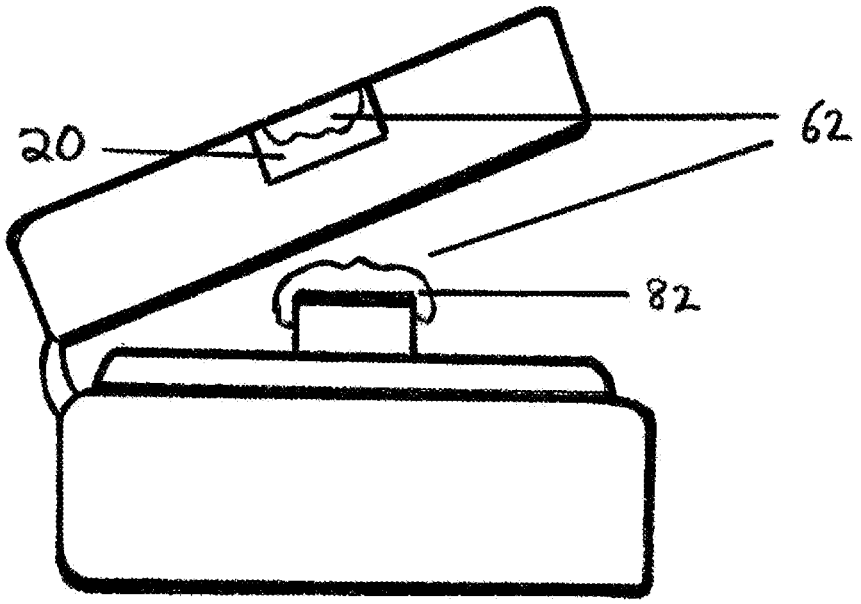
FIG. 27 is a side view of a flip-top tamper-evident container with gummy glue inside a crater and gummy glue adhered on top of a cap spout cover.

FIG. 27 shows a flip-top container with gummy glue inside the crater (20) and on top of the cap spout cover (82). When the flip-top is closed in the manufacturing process, the two gummy glues adhere to one another. When the lid (14) is opened for the first time, the gummy glues pull apart from one another, indicating that the lid has been opened. A third adhesive, perhaps a paper, plastic, or tape laying horizontally on top of the gummy glue on the cap spout cover, may become dislodged from the gummy glue and fall somewhere inside the cap to indicate that the container has been opened.

Figure 28:
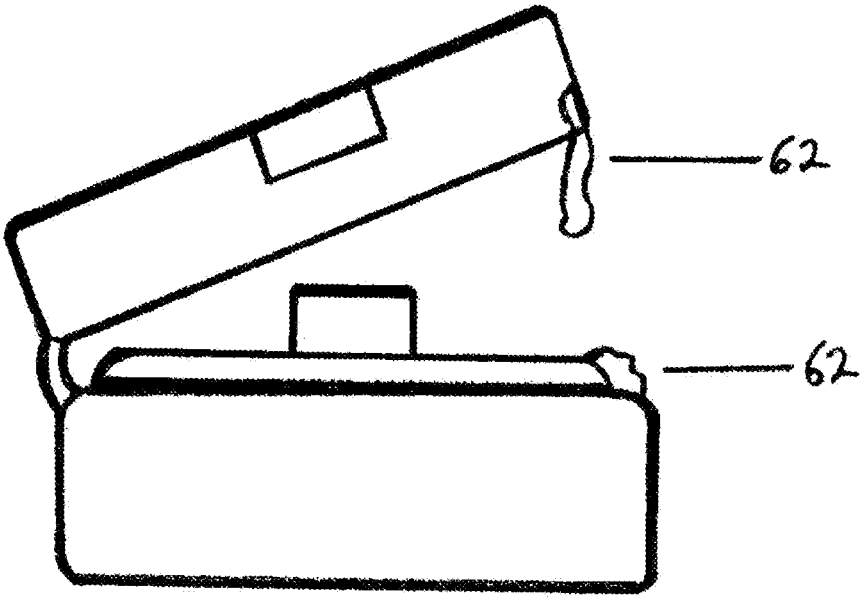
FIG. 28 is a side view of a flip-top tamper-evident container with a gummy glue adhered to the inner wall of the lid of the container cap and another gummy glue adhered on the top and side of the plateau.

FIG. 28 shows a flip-top container with gummy glue (62) hanging from the inner wall (60) of the lid (14) and a gummy glue on the plateau (22) and side of the plateau (22). When the flip-top lid is closed in the manufacturing process, the two gummy glues adhere to one another. When the lid (14) is opened for the first time, the two gummy glues break apart from one another to indicate that the lid has been opened. There does not necessarily need to be a gummy glue (62) on the plateau (22) or side of the plateau (22) for this to work. There can simply be a gummy glue (62) hanging from the inner wall (60) of the lid (14).

Figure 29:
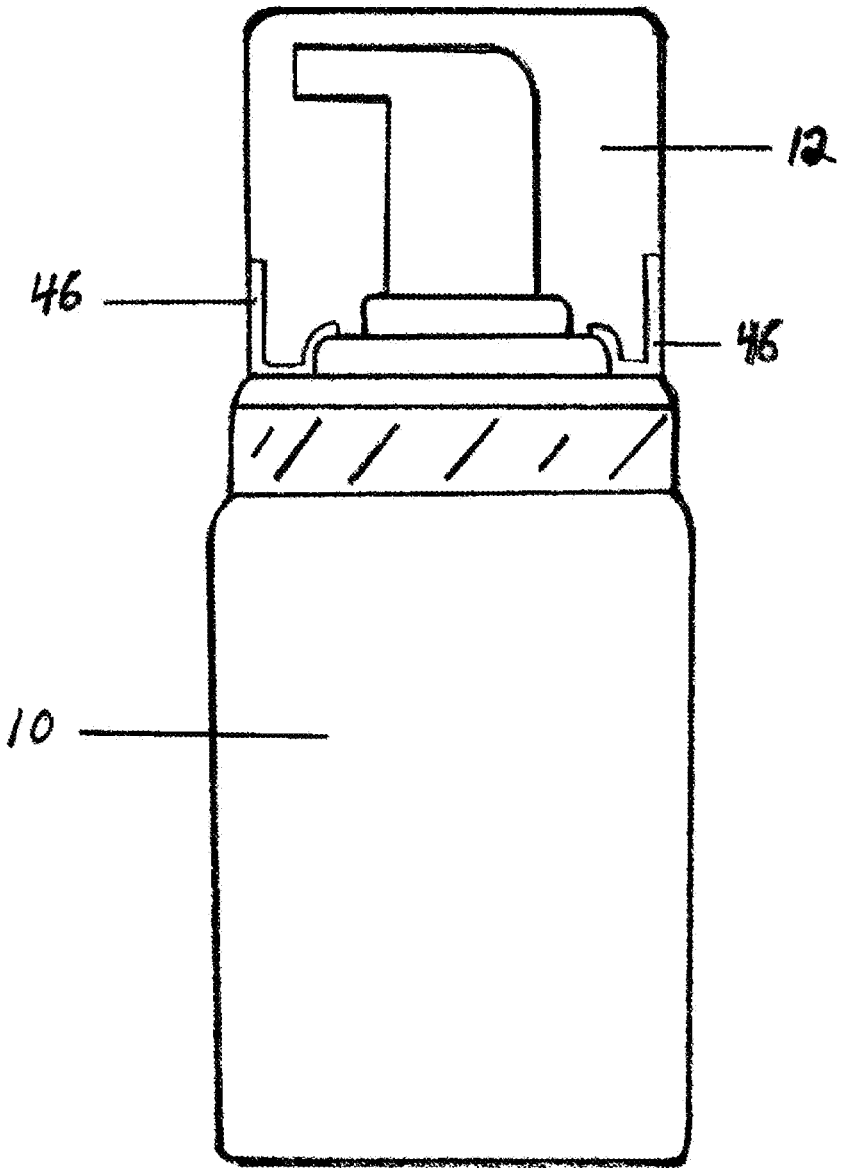
FIG. 29 is a side view of a pump tamper-evident container with two tapes adhered to the inner wall of the lid of the container cap and adhered to the top and sides of the plateau.

FIG. 29 shows a pump spray tamper-evident container with two tapes adhered to the sides of the cap (12) and the plateau (22). When the cap (12) is lifted off of the body (10), the tapes come apart, indicating that the container has been opened.

Figure 30:
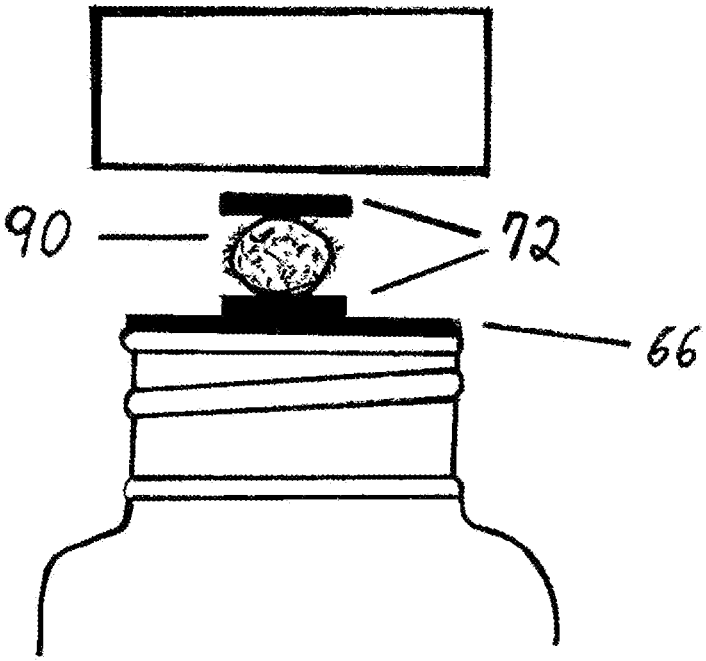
FIG. 30 is a front view of a tamper-evident container with a non-adhesive item sandwiched between a double-sided tape on a mouth cover.

FIG. 30 shows a non-adhesive item (90), in this case, a cotton ball, sandwiched in the middle of a double-sided tape (72) which is adhered to a mouth cover (66). When the cap (12) is unscrewed, the cotton ball is pulled and stretched to indicate that the container has been opened. Once the cotton ball has been stretched, it cannot be shrunk or compacted again.

Figure 31:
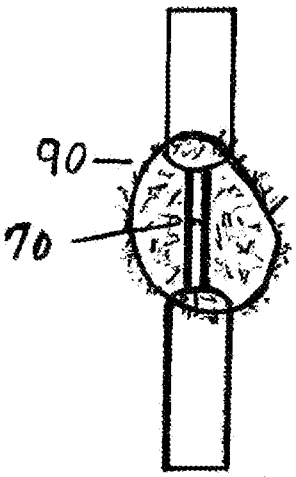
FIG. 31 is a front view of a non-adhesive item adhered to a butterfly-shaped tape.

FIG. 31 shows a non-adhesive item (90), in this case, a cotton ball, adhered to butterfly-shaped tape (46) with a perforation (70). When the cap is unscrewed, the butterfly-shaped tape (46) breaks and the cotton ball is pulled and stretched.

Figure 32:
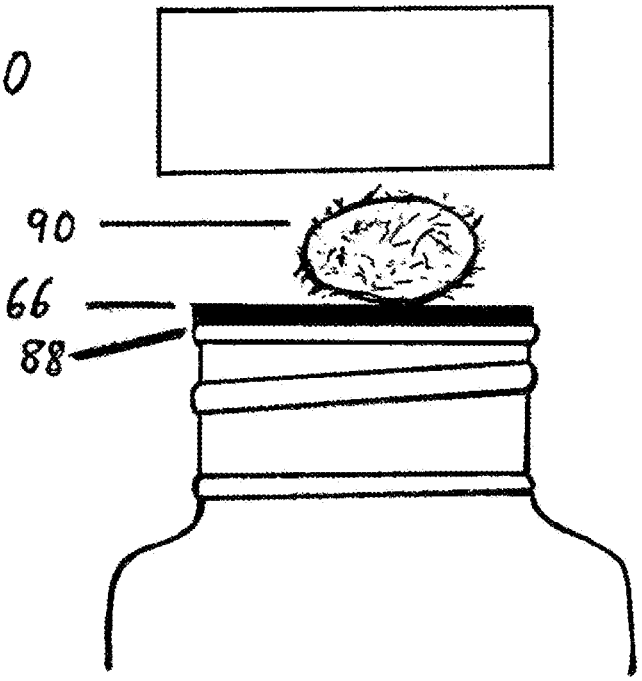
FIG. 32 is a front view of a tamper-evident container with a non-adhesive item that is adhered to a mouth cover that has been sprayed or coated with a spray adhesive.

FIG. 32 shows a non-adhesive item (90) adhered to a mouth cover (66) which has been sprayed with a spray adhesive. In some cases, the non-adhesive item (90) may be brushed with an adhesive or sprayed with a spray adhesive. When the container cap (12) is screwed on to the container body (10), the non-adhesive item adheres to the underside of the cap (12) and the mouth cover (66).

Operation—FIG. 12

The Truly Tamper-evident Container is made of plastic, such as polyethylene, and has a clear, see-through cap (12) which allows a customer to know immediately if a product container, about to be purchased, has been opened or not. The cap (12) has at least one screw thread (84), on the inner wall (60) as does the accepting body neck (50) of the body (10). On top of the body neck (50) is a mouth (88) and on top of the mouth (88) is a mouth cover (66) which can be made of foil, paper, plastic, wood, metal, resin, rubber, or other material. A gummy glue (62), gummy drop (64), tape, plastic, paper, latex, or other adhesive material is adhered on top of the mouth cover (66).

In FIG. 12, when the cap (12) is screwed onto the body neck (50) of the body (10) in the manufacturing process, the cap (12) is lowered along the screw thread (84) and the underside of the cap (12) comes in contact with the gummy glue (62), and adheres there until the user of the product unscrews the cap for the first time. When the cap is unscrewed for the first time, the gummy glue (62) is pulled and stretched with every twist of the cap as it rises along the screw thread (84) until the gummy glue (62) finally breaks apart. In the case of gummy glue, many times the material will shrink, or recoil, after it has been stretched and broken apart. It would be nearly impossible for a saboteur to unscrew a cap, stretch or break an adhesive, taint a product, and then close the container cap or lid and expect the shrunken gummy glue or torn adhesive to reattach to itself. The torn adhesive is a clear indication that the cap has been twisted partially off, or completely off of the body (10) at least one time after the manufacturing process. If the adhesive doesn't come apart, it will still be stretched, which may distort, skew, or change any design, color, or print, such as a manufacturer's name, trademark, logo, or other distinguishing or identifying marks that have been preprinted on the gummy glue by a manufacturer. The general public would not have access to these distinct or customized materials, so, it would be difficult to nefariously replace the adhesive with their own adhesive inside the container for an unsuspecting customer.

If the underside of the cap (12) or the mouth cover (66) has a manufacturer's name, logo, design, trademark, etc. printed or embossed on them, then a gummy glue, separated from that underside of the cap (12) or mouth cover (66), could show the visible proof in the form of that manufacturer's name, logo, trademark, design image, etc., when the gummy glue is lifted from the underside of the cap (12) or mouth cover. In some situations, the gummy glue may not tear apart completely but stretch to show a distortion in the shape, color, or manufacturing ink print, such as the manufacturer's name, logo, trademark, or design of some kind. These stretched distortions are also considered visible indications to the customer that the cap has been partially, or completely unscrewed at least one time, and that the product should not be purchased.

Operation—Other Embodiment—FIG. 25

FIG. 25 shows a flip-top tamper-evident container which are common on collapsible tube-type packaging containers for toothpaste, lotions, and creams. A gummy glue (62) is shown adhered to a cap spout cover (82) located on top of a cap spout (48). When the lid (14) is closed during the manufacturing process, the crater (20) on the underside of the lid (14) is pressed down onto the gummy glue until it is finally opened for the first time by the customer or consumer. When the flip-top lid (14) is opened for the first time, the gummy glue (62) is stretched and pulled apart to indicate that the cap (12) has been opened.

Accordingly, the reader will see that the Truly Tamper-evident Containers of the various embodiments are a much safer packaging system for many everyday consumer products which will have the consumers confident to use, and the manufacturers confident to make without fear of lawsuits. These containers can be produced at a nominal cost to the manufacturers who may or may not, pass on the savings to the customer. In addition, previously used methods of using tape, safety shrink bands, etc., outside the cap may still be utilized as an extra layer of confidence for the customer. There will be no more inconsistencies of products where some manufacturers use foil on the cap spouts, safety shrink bands, or tamper-evident tape on the outside of their containers, etc., while others do not use any such safety protection at all. There would be no more being able to unscrew the cap from the container body and then putting a foreign substance in through the spout. No more not being able to see through the cap in order to see if the foil is on properly, been tampered with, etc. A reduction in the number of injuries, deaths, and lawsuits can be expected from these new tamper-evident containers.

There is no excuse for not having a universally-accepted product container where all product packaging contains the same or nearly the same, system whereby the customer can feel confident that the product they are purchasing has not been tampered with. By having a clear, see-through container cap permanently sealed to the container body, and a folded safety tape or similar item adhered inside the cap where no saboteur can have access to it without signally to the customer that the product has been tampered with, the public and manufacturers can feel confident that no one with nefarious intent will ever easily succeed.

While the above description contains specificities, they should not be construed as limitations on the scope, but instead, as an exemplification of one or more embodiments thereof. Many more variations are possible. For instance, the container may be in many different forms of packaging, in addition to collapsible tubes. The cap may be slightly tinted, colored, or opaque. The size and shape may be different to accommodate the size of the cap, the tackiness of the tape, the placement of the safety tape attached to the foil cover on the spout, the location of the spout and crater, etc. The breakaway point(s) may be narrower or wider or be made of a different material that may be more difficult or easier to break apart than the safety tape.

There are various possibilities with regard to how the cap is connected to the body, where and how the safety tape is set within the cap, how other items such as safety shrink bands, O-rings, or other items are used to show whether or not a container lid has been opened or tampered with, etc., therefore, the scope should be determined not by the illustrated embodiments, but by the claims and their legal equivalents,

I claim:

1. A tamper-evident container comprising:

a container body with a threaded neck and a mouth or opening, a clear or see-through container cap configured to engage with the container body, and at least one tamper-evident adhesive feature comprising an adhesive which is positioned within the container cap and adhered to the container body;

wherein upon initial unscrewing rotation of the container cap relative to the container body simultaneously tears both the adhesive and a substrate to which the adhesive is adhered, thereby producing a detectable change sufficient to indicate tampering.

2. The container of claim 1, wherein the detectable change comprises one or more of stretching, ripping, pulling apart, shredding, skewing, shape, color, size, removal, and degradation.

3. The container of claim 1, wherein at least one tamper-evident adhesive feature comprises an impressed, marked, embossed, or engraved shape configured to convey identifying information regarding a manufacturer, the identifying information including one or more of a name, logo, design, trademark, or image.

4. The container of claim 3, wherein the shape is configured to convey the identifying information on one or more of the underside of the container cap, a threaded inner wall of the container cap, or a mouth cover.

5. The container of claim 1, wherein one or more of the underside of the container cap, a member plateau on top of the container body, or the top of a mouth cover comprise an impressed, marked, embossed, or engraved shape configured to convey identifying information regarding a manufacturer, the identifying information including one or more of a name, logo, design, trademark, or image.

6. The container of claim 5, wherein the shape is configured to convey the identifying information on a tamper-evident adhesive feature.

7. The container of claim 1, wherein at least one substrate comprises one or a combination of plastic, paper, aluminum, rubber, latex, vinyl, wood, cotton, flax, foam, foil, or cloth.

8. The container of claim 1, wherein at least one tamper-evident adhesive feature comprises adhesive on one lengthwise side of the substrate and adhesive on the opposite lengthwise side of the substrate.

9. The container of claim 1, wherein the mouth is covered by a mouth cover or a plateau comprised of one or a combination of aluminum, paper, plastic, wood, resin, metal, latex, foil, cotton, and rubber.

10. The container of claim 1, wherein the container further comprises a substrate comprised of one or more of plastic, paper, aluminum, rubber, resin, latex, vinyl, wood, cotton, flax, foam, foil, and cloth.

11. The container of claim 10, wherein the substrate is configured to adhere to at least one tamper-evident adhesive feature, and the substrate or the tamper-evident adhesive feature is designed to undergo a detectable change when the container cap is twisted or otherwise moved relative to the container body, the change being sufficient to provide evidence of tampering.

12. The container of claim 10, wherein the substrate is adhered between two separate and distinct adhesives.

13. The container of claim 10, wherein the substrate is positioned between two separate and distinct adhesives.

14. The container of claim 10, wherein the substrate comprises a mouth cover or a plateau on top of the container body.

15. The container of claim 1, wherein a tamper-evident feature with a member pull tab with an adhesive end is on the container cap, container body, a plateau, or a mouth cover.

16. The container of claim 10, wherein the substrate is on the container cap or the container body.

17. The container of claim 10, wherein the substrate is brushed, sprayed, or donned with a liquid or spray adhesive.

18. The container of claim 1, wherein at least one tamper-evident feature has at least one of a perforation, nick, cut, or slit.

19. The container of claim 9, wherein the mouth cover or the plateau has a member pull tab and the end of the pull tab is adhered to the container cap or container body.

20. The container of claim 1, wherein an adhesive with no substrate is adhered to the container cap, and a separate adhesive with no substrate is adhered to the container body, and the two adhesives adhere to one another when the container cap is screwed onto the container body.

21. The container of claim 1, wherein the adhesive is adhered to a mouth cover sealed over a mouth or opening of the container body.

22. The container of claim 1, wherein at least one adhesive comprises one or a combination of gummy glue, craft glue, white glue, hot glue, pressure-sensitive adhesives, epoxy, rubber cement, putty, resin, spray adhesive, or edible food glue.

* * * * *